United States Patent [19]

Anderson et al.

[11] Patent Number: 4,978,091

[45] Date of Patent: Dec. 18, 1990

[54] BUNDLING STRAP

[75] Inventors: Franklin R. Anderson, Durham; John M. Schroer, Raleigh, both of N.C.

[73] Assignee: Custom Molders Inc., Durham, N.C.

[21] Appl. No.: 475,785

[22] Filed: Feb. 6, 1990

[51] Int. Cl.[5] ..... B65D 63/00

[52] U.S. Cl. ..... 248/74.3; 24/16 PB; 248/72

[58] Field of Search ..... 248/689, 58, 62, 72, 248/74.1, 74.2, 74.3, 228, 229, 71; 24/16 PB, 16 R, 30.5 P

[56] References Cited

U.S. PATENT DOCUMENTS

| | | | |
|---|---|---|---|
| D. 222,128 | 10/1971 | Schwartz | 24/16 PB |
| 3,049,771 | 8/1962 | Litwin | 248/71 |
| 3,147,523 | 9/1964 | Logan | 24/30.5 P |
| 3,149,808 | 9/1964 | Weckesser | 248/74.3 |
| 3,422,499 | 1/1969 | Merser | 24/16 PB |
| 3,484,905 | 12/1969 | Eberhardt | 24/16 PB |
| 3,720,395 | 3/1973 | Schuplin | 248/229 |
| 4,235,404 | 11/1980 | Kraus | 24/16 PB |
| 4,457,095 | 7/1984 | Stevenson | 24/16 PB |
| 4,470,173 | 9/1984 | Adamson | 24/16 PB |
| 4,490,886 | 1/1985 | Omata | 248/74.3 |
| 4,537,432 | 8/1985 | Meeks | 24/16 PB |
| 4,735,387 | 4/1988 | Hirano | 248/74.3 |

FOREIGN PATENT DOCUMENTS

| | | | |
|---|---|---|---|
| 2462600 | 3/1981 | France | 24/16 PB |
| 2166188 | 4/1906 | United Kingdom | 24/16 R |
| 1323198 | 7/1973 | United Kingdom | 24/16 PB |

OTHER PUBLICATIONS

Hill, F. W., "Cable Harness Clamp", Jun. 1959, IBM Technical Disclosure Bulletin, vol. 2, No. 1.

*Primary Examiner*—Ramon O. Ramirez
*Assistant Examiner*—Robert A. Olson
*Attorney, Agent, or Firm*—Olive & Olive

[57] ABSTRACT

A bundling strap, such as used for bundling a group of wires, includes a spring device for grasping a thin rib or the like thereby avoiding the need for drilling a hole according to the customary practice.

7 Claims, 2 Drawing Sheets

BUNDLING STRAP

BACKGROUND OF INVENTION

1. Field of the Invention

The invention relates to a molded plastic bundling strap for bundling wires or other items and securing the bundled item or items to another structure such as an automobile dashboard panel.

2. Background Art

Numerous forms of plastic bundling straps have been devised and a typical application is that of bundling a group of wires beneath an automobile dashboard. The typical strap has a locking end at one end of the strap into which the opposite end of the strap is inserted and effectively locked in place by suitable mating formations on the strap and locking end. Such a strap also typically includes a pendant portion sometimes referred to in the trade as a "rosebud" and which is adapted to fit into a hole formed in a panel or the like and be locked therein. Thus, the bundled item or items can be fixed relative to the panel or the like in which the pendant portion is secured. U.S. Pat. No. 4,490,886 represents one of numerous patents illustrating the described construction.

A disadvantage of the type bundling strap which requires the presence of a hole for securing the strap to a dashboard panel or the like is that a hole is not always present where it is desired to secure the strap. Thus, it is sometimes necessary to drill or otherwise form a hole in the structure to which the strap carrying the bundled items is to be attached.

The present invention recognizes that most molded automobile panels, dashboards and the like have strengthening ribs, thin walls with exposed edges and the like and it would be desirable to be able to attach bundling straps to such ribs or walls both to avoid the need for holes and to provide a wider choice in locating where a particular strap may be secured to a panel or like structure.

In another aspect of the prior art, U.S. Pat. No. 4,235,404 teaches a bundling strap with what is described as a clamping section for clamping to an edge of a sheet metal section. However, the clamping section is illustrated as having a smooth surface and with no means to forceably grip a surface such as a panel rib. U.S. Pat. No. 4,457,095 shows a type of bundling strap for receiving a fishing rod and having a slotted block for gripping an associated fishing line. However, this type of strap does not lend itself to forceably gripping a panel rib or the like.

It has also been known to provide a bundling strap with an associated tab such as illustrated in U.S. Pat. Nos. 4,470,173 and 4,537,432. However, the straps so illustrated are incapable of being secured to a thin wall surface such as a panel rib or the like.

With the foregoing prior art description in mind, an object of the invention is that of providing a bundling strap having a gripping device enabling the strap and its bundle to be secured to a thin rib, a thin wall or the like and without the need to locate or drill a hole for such purpose. Other objects will become more apparent as the description proceeds.

SUMMARY OF THE INVENTION

A bundling strap according to the invention in a first embodiment incorporates a tab intermediate the length of the strap. On this tab there is mounted a metal clip formed of spring steel with formed teeth and a relatively strong spring action capable of forceably securing the strap to a thin panel, rib or the like by forcing the metal clip over the rib. In a second embodiment, a block-like structure is formed integral with the strap intermediate its length and is provided with a very narrow slot having formed internal teeth which strongly grip and effectively penetrate the surface of a panel rib when forced thereon.

DESCRIPTION OF PREFERRED EMBODIMENTS

Figure 1:
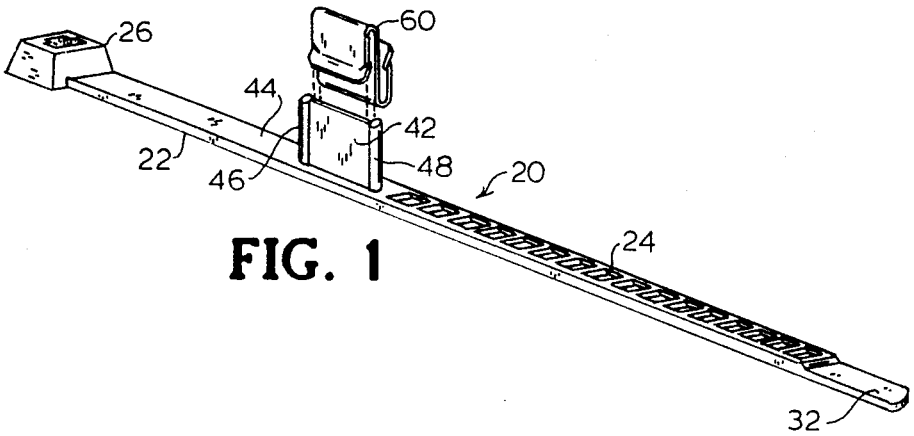
FIG. 1 is an exploded perspective view of a bundling strap and spring assembly according to the invention with the spring positioned to be forced onto the bundling strap tab.
Figure 2:
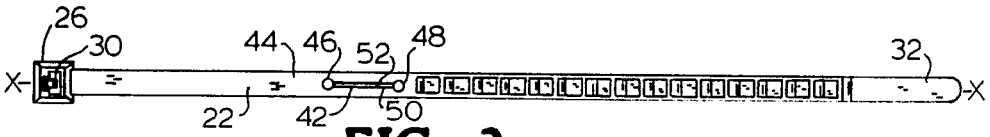
FIG. 2 is a plan view of the bundling strap of FIG. 1 with the spring removed.
Figure 3:
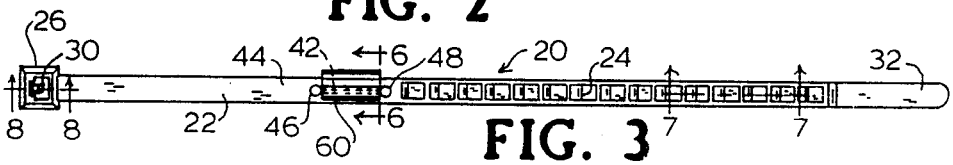
FIG. 3 is a plan view of the bundling strap of FIG. 1 with the spring installed.
Figure 4:
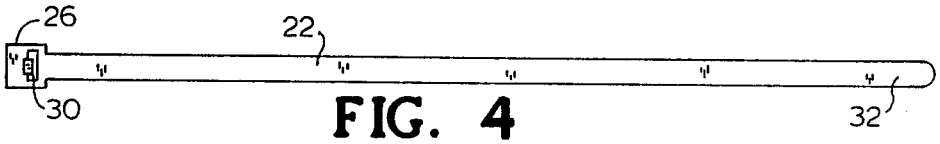
FIG. 4 is a bottom view of the bundling strap of FIG. 1.
Figure 5:
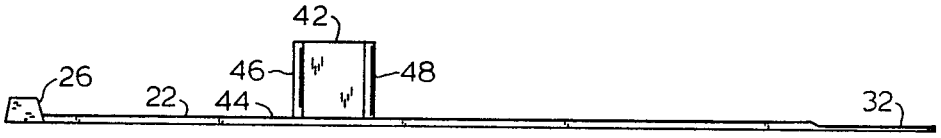
FIG. 5 is a side elevation view of the bundling strap of FIG. 1 with the spring removed.
Figure 6:
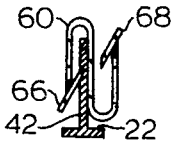
FIG. 6 is a section view taken in the direction of line 6—6 of FIG. 3.
Figure 7:
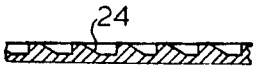
FIG. 7 is a fragmentary enlarged section view taken in the direction of line 7—7 of FIG. 3.
Figure 8:
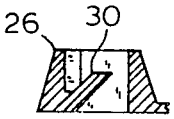
FIG. 8 is a fragmentary enlarged section view taken in the direction of line 8—8 of FIG. 3.
Figure 9:
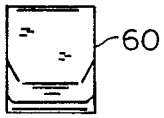
FIG. 9 is a side elevation view of the spring member shown in FIG. 1.
Figure 10:
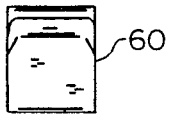
FIG. 10 is a side elevation view of the spring member taken from a direction opposite to that of FIG. 9.
Figure 11:
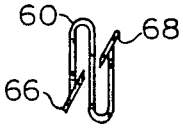
FIG. 11 is a right end view of the spring member.
Figure 12:
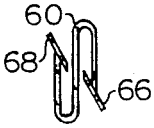
FIG. 12 is a left end view of the spring member.
Figure 13:
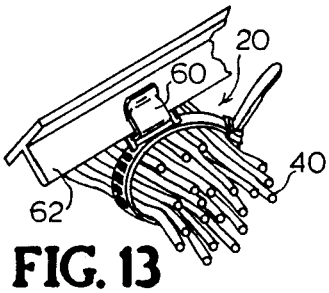
FIG. 13 is a perspective view illustrating the bundling strap of the invention secured to a rib member such as found on the underside of a molded automobile dashboard panel.

Making reference to FIGS. 1–13, the first embodiment bundling strap 20 of the invention comprises a ratchet strip 22 having a elongated, flexible, toothed portion 24 and a locking block 26 having a pawl 30. Locking block 26 is formed integral with ratchet strap 22 and in use, the end 32 of the toothed portion 24 is inserted through locking block 26 and is pulled tight with its bundle load 40 as depicted in FIG. 13.

Of particular significance to the invention, the ratchet strip 22 includes an integrally formed spring mounting tab 42 which extends outwardly from and perpendicular to the outer surface 44. The central plane of tab 42 substantially coincides with the central axis X—X (FIG. 2) of ratchet strip 22. Tab 42 includes a pair of ribs 46, 48 which act as boundaries for the opposed side surfaces 50, 52 (FIG. 2) of tab 42 and also as guides for receiving a somewhat S-shaped, relatively stiff, clamp spring 60 one side of which is forced onto tab 42 as in FIGS. 3 and 6 and the other side of which is forced onto a panel rib 62 as in FIG. 13 to secure the entire bundling strap 20 with its load 40 to the panel or other structure having a thin section suited to receiving the spring 60. Ribs 46, 48 are spaced apart by a distance just slightly greater than the width of spring 60 and which serves to locate spring 60 on tab 42.

Clamp spring 60 is of an available type and is made by the Eaton Corporation of Cleveland, Ohio. Spring 60 is formed of spring steel and includes one set of barbs 66 forming part of a run in surface and adapted to forcibly grasp and penetrate a side surface of tab 42 as in FIG. 6 and another set of barbs 68 forming part of another run in surface adapted to forcibly grasp a panel rib 62 (FIG. 13) or the like as previously referred to. Since strap 20 is typically molded of a tough plastic material and panel ribs as found in automobiles are also typically molded of tough plastic, the barbs are able to engage and strongly grasp both the surface of tab 42 and the surface of rib 62 to which the strap is secured.

Figure 14:
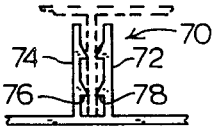
FIG. 14 is a modified gripping arrangement according to the second embodiment.
Figure 15:
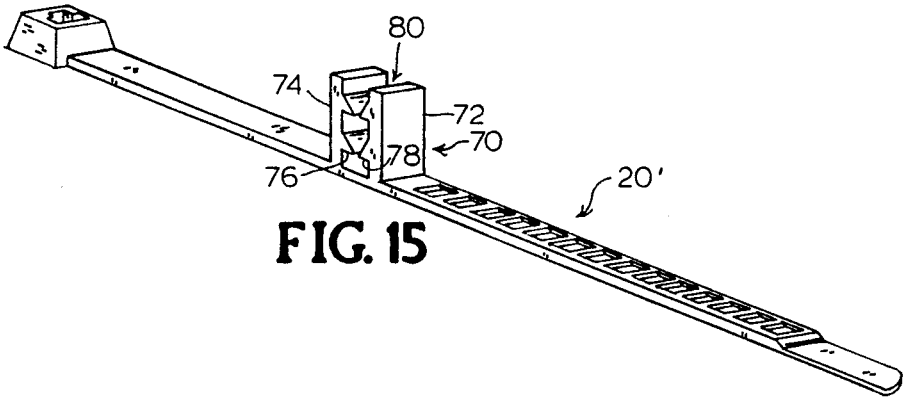
FIG. 15 is perspective view of a bundling strap with the modified gripping arrangement according to the second embodiment of the invention.

In a second embodiment, a gripping block 70 is molded integrally with strap 20' and includes opposed sides 72, 74 having opposed teeth 76, 78 surrounding a very narrow slot 80. Thus, in use, as depicted in FIG. 14, the teeth 76, 78 grasp a thin rib 90 or other thin, sheet-like surface to secure the modified strap 20'. By forming both strap 20' and block 70 of a tough, resilient plastic material, a relatively strong gripping action may be achieved.

We claim:

1. A bundling strap for enclosing an article such as a wire or group of wires comprising a strap of flexible material having integrally formed along one face thereof a row of rachet-like teeth, an enclosure formed at one end of said strap and projecting in a direction transverse thereto, said enclosure defining therein a passage dimensioned to slidably accommodate the part of said strap which is formed with said teeth, said passage being formed with resilient detaining means engageable with said teeth in such manner as to permit sliding movement of said strap in an entering direction and to prevent sliding movement of said strap in a reverse direction, a substantially flat tab formed intermediate the length of said strap and projecting from said one face in a direction transverse to said strap and in a plane extending lengthwise of said strap, said tab together with said strap and enclosure being molded of a plastic material as an integral piece, and a preformed resilient S-shaped metal clip having a first U-shaped section with an inclined run in surface and a gripping surface formed with barbs and fitted in a gripping and barb/engaging relation on said tab and a second U-shaped section having an inclined run in surface and a gripping surface formed with barbs adapted for being fitted in a gripping and barb/engaging relation on a thin flat support section such as a structural rib to which said strap can be attached by means of said clip.

2. A bundling strap for bundling a wire, group of wires or the like comprising a flexible strap for encircling said wires or the like, said strap having formed along one face thereof a row of rachet-like teeth, an enclosure formed at one end of said strap and projecting in a direction transverse thereto, said enclosure defining a passage therein adapted to slidably receive said strap portion having said rachet-like teeth, means formed integrally within said enclosure to grip said teeth so as to prevent withdrawal thereof once fed through said enclosure, an integral substantially flat tab located intermediate the length of said strap and projecting from said face of said strap in a direction perpendicular to the said face of said strap, said flat tab together with said strap and enclosure being formed as a unitary structure, said flat tab being adapted for securely mounting a preformed clamp spring thereon for securing said strap on a thin flat structural support with said preformed clamp spring in firm engagement therewith.

3. A bundling strap as claimed in claim 2 wherein said flat tab is formed with a rib configuration configured to position said preformed clamp spring on said tab.

4. A bundling strap as claimed in claim 3 wherein said flat tab formed intermediate the length of said strap and projecting from said face in a direction perpendicular to the said face of said strap is in a plane extending lengthwise of said strap and including a said preformed clamp spring on said tab comprising a resilient S-shaped metal clip having gripping surfaces and barbs.

5. A bundling strap for enclosing an article such as a wire or group of wires comprising a flexible strap having formed along one face thereof a row of rachet-like teeth, an enclosure formed at one end of said strap and projecting in a direction transverse thereto, said enclosure defining a passage therein adapted to slidably receive the portion of said strap formed with said teeth, said passage being formed with means engageable with said teeth in such manner as to permit sliding movement of said strap in an entering direction and to prevent sliding movement of said strap in a reverse direction, a tab formed intermediate the length of said strap and projecting from said one face in a direction perpendicular to said one face of said strap, said tab together with said strap and enclosure being molded of a plastic material as an integral piece, and a preformed metal clip having a first section fitted in a gripping relation on said tab and a second section adapted for being fitted in a gripping relation on a thin flat support section such as a structural rib to which said strap can be attached by means of said metal clip.

6. A bundling strap as claimed in claim 5 wherein said metal clip first and second sections are formed with barbs for respectively engaging said flat tab and said support section.

7. A bundling strap as claimed in claim 5 wherein said flat tab projects from said one face of said strap in a plane extending lengthwise of said strap.

* * * * *